United States Patent [19]

Hughes

[11] 4,135,714

[45] Jan. 23, 1979

[54] GOLF SWING MUSCLE DEVELOPER

[76] Inventor: Ralph L. Hughes, 6014 S. Croft Ave., Los Angeles, Calif. 90056

[21] Appl. No.: 654,762

[22] Filed: Feb. 3, 1976

[51] Int. Cl.[2] ..... A63B 21/04

[52] U.S. Cl. ..... 272/136; 272/142; 272/67; 273/35 R

[58] Field of Search ..... 273/191 B; 272/136, 272/140, 142, 135, 116, 133, 131, 132, 143

[56] References Cited

U.S. PATENT DOCUMENTS

| | | | |
|---|---|---|---|
| 481,730 | 8/1892 | Miller | 272/136 |
| 1,137,349 | 4/1915 | Patterson | 272/140 |
| 1,139,126 | 5/1915 | Kerns | 272/140 |
| 1,867,642 | 7/1932 | Woods | 272/137 X |
| 2,131,570 | 9/1938 | Riley | 272/140 X |
| 2,848,234 | 8/1958 | Brandon | 273/191 B X |
| 2,951,702 | 9/1960 | Goodwin | 272/140 |
| 3,083,016 | 3/1963 | Sumegi | 272/142 X |
| 3,462,156 | 8/1969 | Gentry | 273/191 B X |
| 3,703,294 | 11/1972 | Fitch | 272/142 X |
| 3,966,203 | 6/1976 | Bickford | 272/118 |

FOREIGN PATENT DOCUMENTS

| | | | |
|---|---|---|---|
| 148953 | 7/1920 | United Kingdom | 272/131 |

*Primary Examiner*—William H. Grieb
*Assistant Examiner*—William R. Browne

[57] ABSTRACT

This invention consists of a flexible cord attached to and wound around a strong spring-loaded, spring-retarded, spring resisted or spring-counterbalanced pulley mounted upon a wall or other stationary vertical support surface, with a handle of wood or other material attached to the other end of the flexible cord so that when the handle is pulled in a downward movement away from the strong spring-loaded pulley, in a simulated golf stroke downswing, the cord rotates the pulley against the strong force or tension of the counterbalancing spring that is connected to the pulley. By making many continuous and repeated downswings with this apparatus all of the muscles used in driving a golf ball are strained and strengthened, enabling the golfer to hit the golf ball farther when playing on a golf course.

5 Claims, 7 Drawing Figures

GOLF SWING MUSCLE DEVELOPER

Perhaps the greatest desire and the greatest ambition of the average golfer is to hit a long straight drive from the golf tee like the golf professionals do. Unlike many of the long hitters in golf the average player does not have the time and money to spend driving hundreds of golf balls daily on the practice tee. Their golf swing muscles do not get the opportunity to develope properly to enable the golfer to hit the long drives they would like so much to do. The regular use of my invention will enable the average golfer to increase the length of his golf drives.

This invention relates to athletic exercising equipment and has for its purpose to provide means for strengthening the muscles of the legs, back, abdomen, shoulders, arms, wrists and hands to enable a golfer to hit a longer, more powerful drive with a golf club and ball.

The main feature of this invention is to provide a flexible cord attached to and wound around a spring-loaded, spring-retarded, spring-resisted or spring-counterbalanced pulley, with a handle of wood or other material attached to the other end of the flexible cord so that when the spring-loaded pulley is attached to a wall or otherwise supported, the handle may be pulled away from the pulley, in a simulated golf stroke downswing, to unwind the cord against the force or tension of the counterbalancing spring that is connected to the pulley.

A further feature of this invention is to provide a powerful "constant force" or flat coiled clock-type spring attached to the pulley so that when a person makes a simulated golf stroke downswing with the handle a considerable effort of approximately 10 to 50 or more pounds of force is necessary to complete the simulated golf stroke downswing, and when this is followed by a simulated golf stroke backswing of the handle the spring-loaded pulley automatically re-winds the flexible cord as the spring partially unwinds, causing a reverse rotation of the pulley. By making many continuous and repeated downswings with this golf swing muscle developer all muscles used in driving a golf ball are strengthened, enabling the golfer to hit the golf ball farther when playing on a golf course.

Further features of this invention and further objects to be attained will be described in the following specification. It is to be understood that the invention resides mainly in the handle with a flexible cord attached to and wound around a supported pulley that is connected to and controlled or counterbalanced by a powerful coiled spring allowing the handle to be pulled, in a simulated golf stroke downswing, against the tension of the spring. Many changes, especially with regard to specific details mentioned may therefore be made without departing from the essence of the invention.

More specific objects and features of this invention will become apparent from the following description when considered in connection with the accompanying drawings, in which FIG. 1 is a drawing of a man holding the handle of the golf swing muscle developer as he is about to start his simulated golf stroke downswing and also as he completes his simulated golf stroke backswing.

Figure 4:
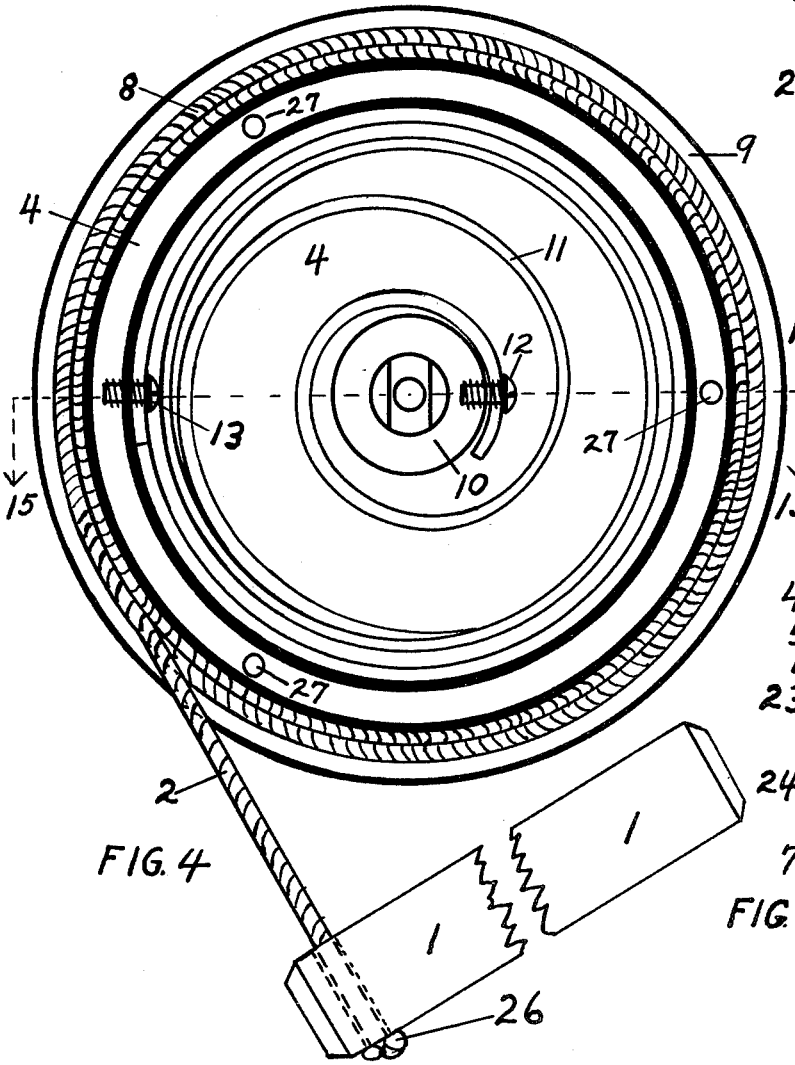
Figure 5:
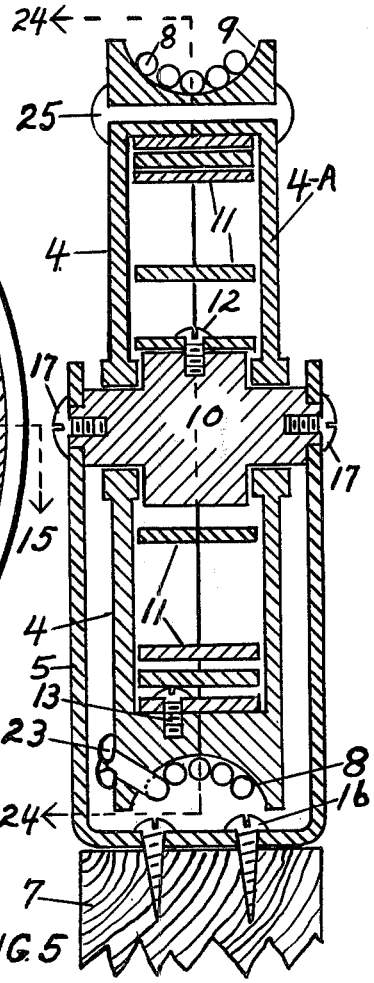

FIG. 4 is a drawing of a side view from the inside of the spring-loaded pulley, along line 24—24 of FIG. 5, showing the powerful clock-type flat coiled spring as may be installed within the pulley of this invention and showing the flexible cord wound around the inside circumference of the pulley groove and attached to the handle that is pulled away from the pulley in a simulated golf stroke downswing.

FIG. 5 is a drawing of a sectional view from above, along line 15—15 of FIG. 4, of the powerful spring-loaded pulley shown in FIG. 4 and shows a flat clock-type coiled spring attached to the inside of the pulley and also to the stationary axle that is supported by and affixed to a mounting bracket that is attached to a wall stud or other support and also shows the flexible cord wound around and attached to the pulley which rotates freely around the axle in its center hole bearing surface.

Figure 6:
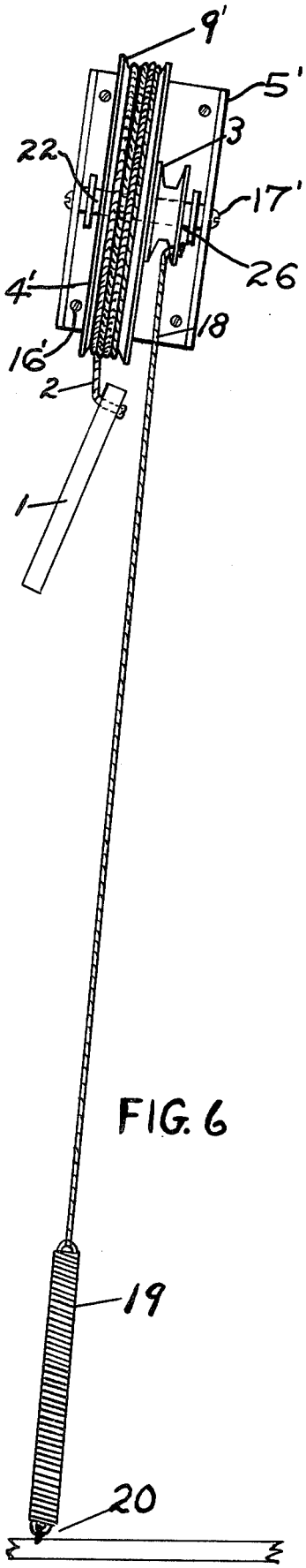

FIG. 6 is a drawing of a frontal view of a spring-loaded or spring-resisted pulley as embodied in this invention in which the handle is attached to the flexible cord wound around the pulley, as in FIGS. 1, 2, 3, 4 and 5, but with an additional pulley groove and having another flexible cord attached thereto and also to a strong powerful coiled expansion spring so that as the handle and cord are pulled away from the first pulley groove in a simulated golf stroke downswing the second pulley groove will also rotate and wind up the second flexible cord against the tension or force of the powerful coiled expansion spring.

Figure 7:
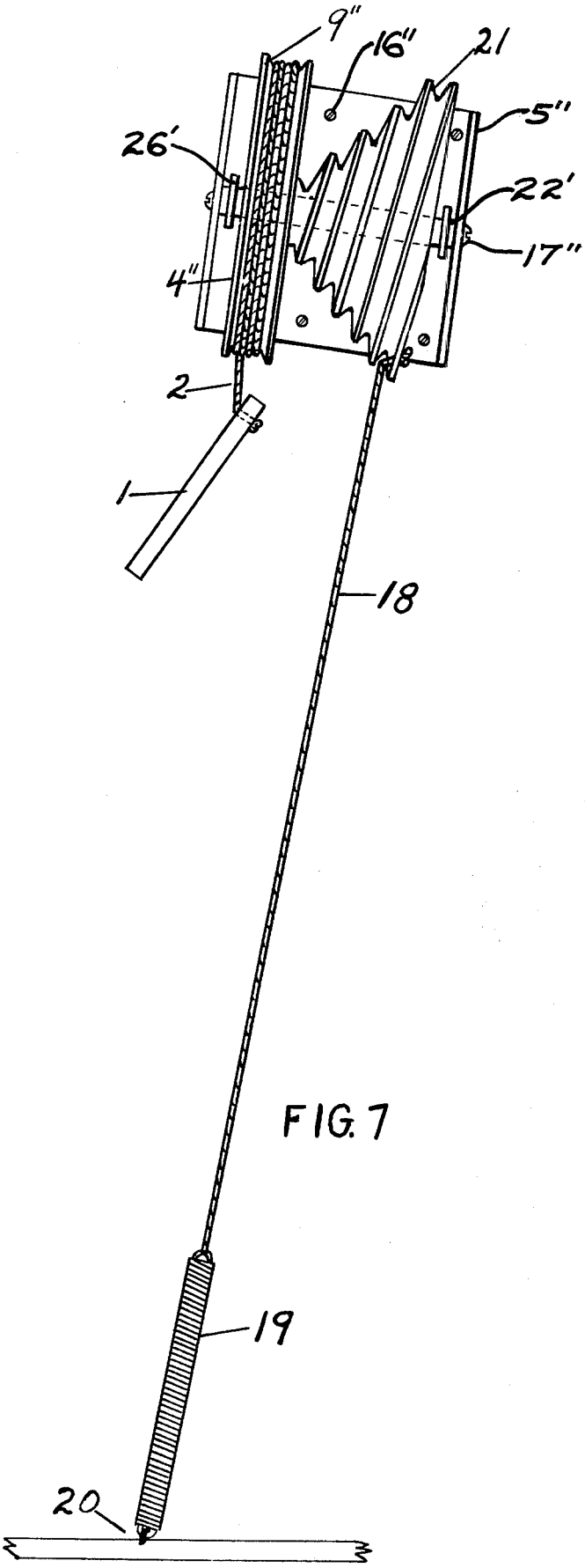

FIG. 7 is a drawing of a frontal view of a modification of the spring-retarded, spring-resisted or spring-counterbalanced pulley, as embodied in FIG. 6, but modified slightly to employ a spiral-threaded, cone-shaped pulley groove attached to the counter-balancing spring by the flexible cord to permit a more constant force effect of the spring by reducing the rate of expansion of the spring for each revolution of the pulley as the spring length is expanded during the travel of the first flexible cord and handle by the movement of the simulated golf stroke downswing.

The invention consists mainly of a handle of wood or other material connected to a flexible cord that is itself wound several turns around and attached to the groove of a pulley, whose rotation is retarded, resisted or counter-balanced by a strong coiled spring so that when the handle is pulled away from the pulley in a simulated golf stroke downswing the flexible cord will unwind on the pulley groove as it rotates the pulley, causing the strong coiled spring to stretch or bend and thus requiring a strong force or power by the operator to perform the simulated golf stroke downswing. Repeated use of this invention in frequent exercises in performing the simulated golf stroke downswing will result in strengthening the muscles of the body, legs, shoulders, arms, wrists and hands to enable the golfer to drive a golf ball farther while playing on a golf course.

Figure 1:
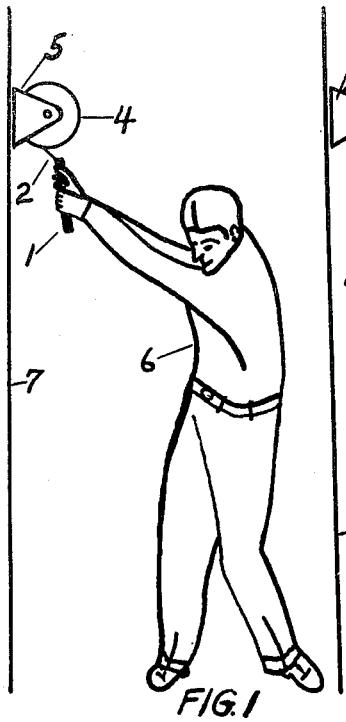
Figure 2:
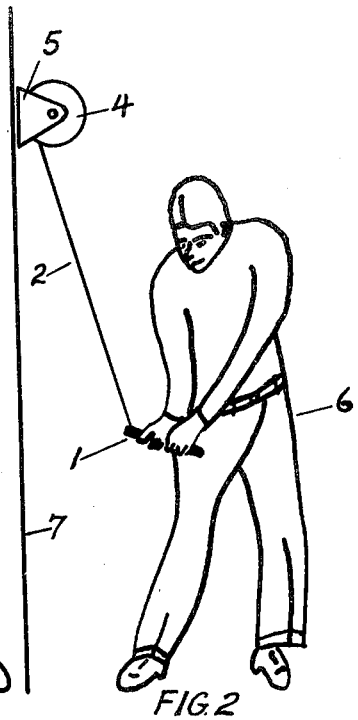
FIG. 2 is a drawing of a man as he completes approximately one half of his simulated golf stroke downswing by pulling down on the handle and cord attached to the powerful spring-loaded pulley of the golf swing muscle developer.
Figure 3:
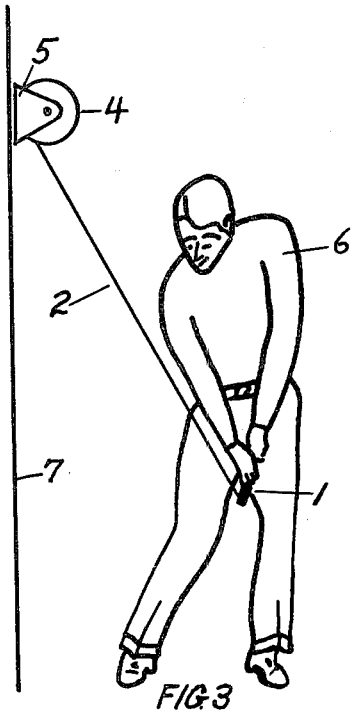
FIG. 3 is a drawing of a man as he completes the simulated golf stroke downswing with the handle and cord of the golf swing muscle developer by stretching or winding the powerful spring attached to the pulley of the golf swing muscle developer.

As shown in FIGS. 1, 2 and 3 the golf swing muscle developer consists essentially of a handle 1 attached to a flexible cord 2 that is wound in several turns onto, and attached to a spring-loaded, spring-retarded, spring-resisted or spring-counterbalanced pulley 4 that is supported by a mounting bracket 5 to a wall 7 or other supporting structure so that the operator 6 can pull the handle 1 away from the pulley 4 in a simulated golf stroke downswing against the force or tension of the resisting spring.

As shown in FIG. 4, which is an inside view of the pulley 4 taken along line 24—24 of FIG. 5, and also showing a side view of the axle 10, the handle 1 is attached to the flexible cord 2, by a knot 26 tied at the end of the flexible cord, that is wound with a few turns 8 around the groove 9 of the pulley 4 which rotates upon the stationary axle 10. A retarding, resisting or counterbalancing constant-force or clock-type spring 11, as may be used in this invention, is attached at its inner end to the axle 10 by a fastener at 12 and is also attached at its outer end to the inside of the pulley 4 by another fastener at 13.

As shown in FIG. 5, which is a sectional view from above, taken on line 15—15 of FIG. 4, the pulley 4 rotates upon the axle 10 which is attached, by fasteners 17, to a mounting bracket 5 that may be attached to a wall stud 7 or other vertical supporting surface by the fasteners at 16. The few turns of the flexible cord 8 are shown wound around the inside of the groove 9 and attached at 23 to the pulley 4, which may be constructed, as shown, in the shape of two hollow sides 4 and 4-A that are joined together by fasteners 25 in holes 27, after the constant force flat coiled spring 11 has been installed within one side of the hollow shell of the pulley 4.

As shown in FIG. 6 the handle 1 is attached to a flexible cord 2 that is wound in a few turns around and attached to the groove 9 of the pulley 4, as in FIGS. 1, 2, 3, 4 and 5, however in this instance a second length of flexible cord 18 is attached to a second pulley groove 3 of the pulley 4 and to a strong coiled expansion spring 19 that may be affixed near the bottom of a wall or other anchoring structure as at 20. The pulley 4' rotates freely upon the stationary axle rod 22, against the tension of spring 19, when the handle 1 is pulled away from the pulley 4' during the movement of the simulated golf stroke downswing. The axle rod 22 is attached to the mounting bracket 5' by fasteners 16 and pulley 4' is positioned in place by the loose fitting spacer washers 26. The mounting bracket 5' is attached by the fasteners 16 to any adequate supporting surface.

As shown in FIG. 7 the handle 1 is attached to a flexible cord 2 that is wound in a few turns around and attached to the groove 9 of the pulley 4 as in FIGS. 1, 2, 3, 4, 5 and 6, but in this instance the second flexible cord 18 is attached to a second groove 21 of pulley 4 that is constructed in a spiral, cone-shaped manner and also attached at its other end, to a strong coiled expansion spring 19 that may be anchored near the floor at 20 as in FIG. 6. The pulley 4 is attached to and rotates freely upon a stationary axle rod 22' that may be attached to and supported by a garage wall stud or other supporting structure by the mounting bracket 5", spacer washers 21' and fasteners 16" and 17", as in FIG. 6.

The operation of the golf swing muscle developer when attached to a garage wall stud or other supporting structure as shown in FIGS. 1 and 5 is as follows:

When the operator 6 takes hold of the handle 1 and pulls it downward in a simulated golf stroke downswing as shown in FIGS. 1, 2 and 3 the flexible cord 2 that is wound around and attached, as at 23, to the pulley 4 by several turns 8 in the groove 9, the pulley 4 is rotated as the flexible cord 2 is partially unwound from the pulley 4. This rotation of the pulley 4 also winds up or tightens the flat coiled constant force spring 11, as installed within the pulley 4 in FIGS. 4 and 5, requiring the application of a strong pull or force by the operator 6 upon the handle 1 of the golf swing muscle developer. When, after completion of the simulated golf stroke downswing, as shown in FIG. 3, the operator then returns the handle 1 to its original position near the pulley 4, as shown in FIG. 1, by a movement of the hands, arms, etc., in a simulated golf stroke backswing, the coiled spring 11 automatically rewinds the cord 2 within the groove 9 of the pulley 4 as shown at 8 in FIG. 5. The repeated operation of the golf swing muscle developer, as described above, for the desired number of times, soon requires a great effort by the operator, as his muscles becomed tired from the effort required, and this frequent straining of the muscles that are used in this simulated golf stroke downswing will soon cause the building or strengthening of these muscles over a period of time and enable the golfer to hit a longer drive with a golf club and ball when playing on a golf course—which is the great desire of most golfers.

The operation of the golf swing muscle developer as shown in FIG. 6 is as follows:

When the operator pulls the handle 1 away from the pulley 4 in a simulated golf stroke downswing as shown in FIGS. 1, 2 and 3, the flexible cord 2 that is wound around and attached to the groove 9 of the pulley 4 also rotates the second groove 3 of pulley 4 and causes the flexible cord 18 to wind up in the groove 3 and pull or stretch the strong coiled expansion spring 19, requiring a great effort or force to be expended by the operator. As the operator returns the handle 1 to its original position, as shown in FIG. 1, by the movement of a simulated golf stroke backswing, the cord 2 is automatically rewound in groove 9 of pulley 4 by the contraction of the strong expansion spring 19 as cord 18 unwinds on groove 3 of the pulley 4. The repeated operation of the golf swing muscle developer, as described above, soon puts a strain on the operator's muscles that are used in making a golf swing, and after a period of time the muscles will become stronger and enable the golfer to hit a longer drive with a golf club and ball.

The operation of the golf swing muscle developer as shown in FIG. 7 is similar to that as shown in FIG. 6, but with the use of a spiral, cone-shaped groove 21 on pulley 4. As the handle 1 is pulled away from the pulley 4 the rotation of pulley 4 and groove 21 causes the flexible cord 18 to wind up within the spiral groove 21. Each revolution of the pulley 4 winds the cord 18 into a smaller diameter portion of the spiral groove 21, thus requiring a reduced rate of expansion of the spring 19, permitting the operator to put forth a more constant force on handle 1 to complete the simulated golf stroke downswing, even though the pressure or tension required to expand spring 19 becomes greater as the spring 19 is stretched or expanded to a greater length as the simulated golf stroke downswing progresses.

Having thus described my invention, I claim:

1. A golf swing muscle developer comprising a handle, a flexible cord, a pulley, a stationary axle, a mounting bracket and an elongated coiled spring means; said handle connected to one end of said flexible cord, the other end of said flexible cord wound around and attached to said pulley, said pulley mounted and rotatable upon said stationary axle, said stationary axle attached to said mounting bracket, means for attaching said mounting bracket to a supporting surface, means for anchoring one end of said coiled spring means to a stationary support, means for connecting the other end of said coiled spring means to said pulley whereby the pulling of said handle away from said pulley, by the operator in performing a simulated golf stroke downswing, causes said flexible cord to unwind on the groove of said pulley and to rotate said pulley on said stationary axle against the strong tension of said coiled spring means as said coiled spring means is stretched by this action; said spring means causing automatic rewinding of said flexible cord in groove of said pulley when the operator returns said handle toward said pulley when making a simulated golf stroke backswing.

2. A golf swing muscle developer as in claim 1; said handle connected to said pulley by a first length of said flexible cord wound around and attached to a first groove of said pulley, said pulley mounted and rotatable on said stationary axle, said stationary axle connected to a supporting surface by said mounting bracket, one end of said coiled spring means anchored to a stationary support, the other end of said coiled spring means connected to a second groove of said pulley by a second length of said flexible cord whereby the pulling of said handle away from said pulley, by the operator in performing a simulated golf stroke downswing, the first length of said flexible cord is caused to unwind on said first groove of said pulley as said pulley is rotated against the increasing power or tension of said coiled spring means by the stretching of said coiled spring means as the said second length of said flexible cord is wound upon said second groove of said pulley.

3. A golf swing muscle developer as in claim 1; said handle connected to said pulley by a first length of said flexible cord wound around and attached to a groove of said pulley, means for attaching said stationary axle to a supporting surface with said mounting bracket, one end of said coiled spring means anchored to a stationary support, the other end of said coiled spring means connected to a spiral, cone-shaped groove of said pulley by a second length of said flexible cord whereby the pulling of said handle away from said pulley, by the operator in performing a simulated golf stroke downswing, the first length of said flexible cord partially unwinds on the groove of said pulley as said pulley is rotated against the increasing resistance power of said coiled spring means by the stretching of said coiled spring means as the second length of said flexible cord is wound upon said spiral, cone-shaped groove of said pulley; said coiled spring means unwinds said second length of said flexible cord from said spiral, cone-shaped groove of said pulley when said coiled spring means returns to its original position.

4. A golf swing muscle developer comprising a pulley, a handle, a flexible cord, an axle, a mounting bracket and an elongated coiled spring means; said pulley attached to said axle, said axle attached to said mounting bracket, means for attaching said mounting bracket to a supporting surface, said flexible cord wound in groove of said pulley, one end of said flexible cord attached to the movable end of said spring means, means for attaching the other end of said spring means to a stationary support, the other end of said flexible cord attached to said handle whereby the pulling of said handle and said flexible cord away from said pulley, by the operator in performing a simulated golf stroke downswing, rotates said pulley against the tension of said spring means as said spring means is stretched by this action, means provided in said elongated spring means to automatically rewind said flexible cord in groove of said pulley when the operator returns said handle toward said pulley in a simulated golf stroke backswing.

5. A golf swing muscle developer as in claim 4, further including a first length of said flexible cord attached at one end to said handle, the other end of said first length of said flexible cord wound in and attached to a first groove of said pulley, a second length of said flexible cord attached at one end to a movable end of said elongated spring means, the other end of said second length of said flexible cord wound in and attached to a second groove of said pulley whereby as said handle is pulled away from said pulley said first length of said flexible cord unwinds from said first groove of said pulley and rotates said pulley against the tension of said spring means as said second length of said flexible cord is wound in said second groove of said pulley; said spring means automatically rewinds said first length of said flexible cord in said first groove of said pulley when said handle is returned toward said pulley.

* * * * *